US011008140B2

(12) United States Patent
Gómez Cao

(10) Patent No.: US 11,008,140 B2
(45) Date of Patent: May 18, 2021

(54) CAP COUPLED TO A CONTAINER

(71) Applicant: GOMEZ CAO INNOVATIONS & INVENTIONS, S.L., Barcelona (ES)

(72) Inventor: José Luis Gómez Cao, Barcelona (ES)

(73) Assignee: GOMEZ CAO INNOVATIONS & INVENTIONS, S.L.

( * ) Notice: Subject to any disclaimer, the term of this patent is extended or adjusted under 35 U.S.C. 154(b) by 0 days.

(21) Appl. No.: 16/313,545

(22) PCT Filed: Jun. 15, 2017

(86) PCT No.: PCT/ES2017/070434
§ 371 (c)(1),
(2) Date: Dec. 27, 2018

(87) PCT Pub. No.: WO2018/002399
PCT Pub. Date: Jan. 4, 2018

(65) Prior Publication Data

US 2019/0315526 A1 Oct. 17, 2019

(30) Foreign Application Priority Data

Jun. 28, 2016 (ES) ..... ES201630870

(51) Int. Cl.
*B65D 41/58* (2006.01)
*B65D 45/32* (2006.01)
(Continued)

(52) U.S. Cl.
CPC ..... *B65D 41/58* (2013.01); *B65D 45/32* (2013.01); *B65D 50/06* (2013.01); *B65D 51/24* (2013.01)

(58) Field of Classification Search
CPC .... B65D 41/02; B65D 41/04; B65D 41/0407; B65D 41/0414; B65D 41/0421;
(Continued)

(56) References Cited

U.S. PATENT DOCUMENTS 4,512,484 A 4/1985 Mar
5,314,084 A * 5/1994 Folta ..... B65D 51/241 215/249
(Continued)

FOREIGN PATENT DOCUMENTS

EP 0989065 A 3/2000
EP 1921018 A1 5/2008
(Continued)

OTHER PUBLICATIONS

International Search Report and Written Opinion for corresponding international application No. PCT/ES2017/070343, dated Aug. 17, 2017.

*Primary Examiner* — Kareen K Thomas
(74) *Attorney, Agent, or Firm* — Tarolli, Sundheim, Covell & Tummino LLP

(57) ABSTRACT

The invention relates to a cap designed to be coupled to the neck of a container. The cap comprises an inner body and an outer body coupled around the inner body, the rotation of the outer body causing same to move in an axial direction with respect to the inner body. The inner body comprises a peripheral skirt having a lower part split into a plurality of feet. The feet comprise outer surfaces that form a frusto-conical shape with a sloped generatrix converging upwards, and inner surfaces with projections that delimit a circular hollow. The cap also comprises a sealing device for preventing the rotation of the outer body with respect to the inner body.

18 Claims, 5 Drawing Sheets

(51) Int. Cl.
*B65D 50/06* (2006.01)
*B65D 51/24* (2006.01)

(58) Field of Classification Search
CPC ..... B65D 41/0428; B65D 41/0435; B65D 41/0442; B65D 41/0457; B65D 41/0464; B65D 41/62; B65D 41/58; B65D 51/24; B65D 50/06; B65D 45/32; B65D 45/325; B65D 2251/0015; B65D 51/248
USPC ..... 215/250, 251, 252, 253, 254, 255, 256, 215/273, 274, 276, 217
See application file for complete search history.

(56) References Cited

U.S. PATENT DOCUMENTS

RE40,003 E * 1/2008 Bennett ..... B65D 41/48 215/251
8,028,848 B2 * 10/2011 Pugne ..... B65D 55/022 215/330
8,235,232 B2 * 8/2012 Isogai ..... B65D 47/0838 215/253
8,567,621 B2 * 10/2013 Chae ..... B65D 45/322 215/274
8,950,609 B2 * 2/2015 Aneas ..... B65D 51/002 215/247
2001/0002012 A1 * 5/2001 Yeaton ..... B65D 41/0442 215/44
2004/0104193 A1 * 6/2004 Yashima ..... B65D 51/18 215/344
2004/0232167 A1 * 11/2004 King ..... B65D 47/242 222/153.14
2010/0181315 A1 * 7/2010 Imoda ..... B65D 47/103 220/270

FOREIGN PATENT DOCUMENTS

EP 3208210 A1 8/2017
ES 2212876 A1 8/2004
ES 2245183 A1 12/2005
WO 2006002710 A1 1/2006
WO 2017077154 A1 5/2017

* cited by examiner

CAP COUPLED TO A CONTAINER

RELATED APPLICATIONS

The present invention is a U.S. National Stage under 35 USC 371 patent application, claiming priority to Serial No. PCT/ES2017/070434, filed on 15 Jun. 2017; which claims priority of ES P201630870, filed on 28 Jun. 2016, the entirety of both of which are incorporated herein by reference.

OBJECT OF THE INVENTION

The invention, as expressed in the title of this specification, relates to a cap which is intended to be coupled to the neck of a bottle type container, for example, containing a beverage such as wine, as well as other gasified products and beverages the invention is characterised in that it is intended to be able to use the invention the cap includes a characteristic sealing device which has the utility of blocking the rotation and closing of the closure both before and after opening the container.

TECHNICAL PROBLEM FOR SOLVING AND BACKGROUND OF THE INVENTION

Various types of plugs are presently known for closing the container tips, such as cork plugs, plastic material plugs and also lids or lids in the form of a metal material bowl; wherein said latter cup shaped plugs include a front ring or disc of elastic material that is in contact with the mouth of the container to ensure the sealing of said container.

Currently, when a bottle or container is opened with the plastic cap for the first time, a sealing ring is separated by breaking point portions joining said sealing ring to the plastic cap.

Said sealing ring is then held next to the neck of the bottle, and said sealing ring is held separated from the cap, indicating that the bottle has been opened.

Plastic plugs in the market function with an internal thread, while other safety plugs (for corrosive liquids, for example), including a thread; so that when a turn is made and simultaneously pressed on the tee a portion of the cap assembly opens the bottle releasing its mouth.

DESCRIPTION OF THE INVENTION

In order to achieve the objectives and to avoid the drawbacks mentioned above, the invention proposes a plug configured to be coupled to a neck of a package; wherein said neck has on its exterior a perimeter shoulder.

The inventive cap comprises an inner body and an outer body coupled around the inner body; wherein the rotation of the outer body causes it to move in an axial direction with respect to the inner body.

The inner body 1 of the cap of the invention comprises a perimeter skirt having a fragmentary bottom part in several legs including end edges capped by outwardly projecting end ribs.

The legs further comprise outer surfaces which form a frustoconical configuration with an upwardly converging inclined generatrix; and internal surfaces where the projections are started which delimit a circular recess corresponding to the perimetral shoulder; wherein the projections of the lugs fit into said perimeter shoulder in a closed position of the cap.

The cap also comprises a sealing device for blocking the rotation of the outer body with respect to the inner body.

The inner body and the outer body 2 include male elements and female elements that are complementary to each other; wherein the male elements are fitted into the female elements.

In one embodiment, the male elements are integral to the inner body and the female elements are located in the outer body.

The female elements comprise internal helical path slots located in an annular inner surface of the outer body, while the male elements comprise lugs protruding from an outer surface of the inner body.

In one embodiment, the male elements are cylindrical lugs, while in another embodiment the male elements are angular section lugs that follow a helical path.

The sealing device comprises a hinged flange located in correspondence with a through window of the outer body; wherein said hinged flange is joined to the outer body by at least one hinged hinge.

The hinged flange comprises two opposing wings which in an anchoring position of the hinged flange, said contracted wings are facing the end faces of the male element, thereby preventing rotation of the outer body with respect to the inner body.

The locking wings of the hinged flange include lugs which fit against two back faces of the through window when said hinged flange of the sealing device is located in a locking position.

In one embodiment the outer body comprises an annular ring shaped structure, while in another embodiment the outer body comprises an annular structure closed by one of its ends by a base, wherein an internal extension has a lower edge facing a top base of the inner body; said internal extension having a tubular configuration.

The inner body of the plug includes an inner annular partition disposed concentrically with respect to the perimeter skirt; between said inner annular partition and the perimeter skirt, an annular groove is generated where an upper part of the neck is fitted which has an annular edge that delimit the mouth of the container, and said annular rim seats against a bottom of the annular groove of the inner body of the cap.

The inventive cap is made by injection of plastic material, without discarding other materials.

The hinged flange of the sealing device, apart from the joint hinged to the outer body of the cap, includes a second point joint that is allowed to break in order to collapse said hinged flange.

It should be noted that the weight of the cap of the invention is practically the same as those heretofore known, and while the costs of the plastic material are exactly the same in all cases, at the end the cost of the inventive plug is also practically the half.

The novel plug of the invention prevents the thread and at the same time the cork material; the invention is characterised in that it is 100% recyclable, while some of the present plugs are not recyclable to 100%. In order to achieve that it is fully recyclable, polyethylene is used, the invention relates to a material which is allowed in all the countries of the world in terms of sanity, not like the BSFENOL for example, which is prohibited in many countries.

It should be noted that the inventive plug is of further use in order to effectively maintain the gas, but is a packaging plug. Another thing is that once the package has been opened, an use can be provided as a rear use plug, since it achieves a reliable sealing and fitting perfectly to the neck or neck of the container, such as a bottle, so that the gas is perfectly held.

The invention relates primarily to the application of the cap of the invention for the wine or vena cava bottles and also to smaller bottles containing soft drinks and bees.

Countries such as Germany, Italy and France begin to require this type of plugs.

Next to facilitate a better understanding of this specification and forming an integral part thereof, the invention relates to a series of figures in which an illustrative and non-limiting character is represented by the purpose of the invention.

DESCRIPTION OF AN EXEMPLARY EMBODIMENT OF THE INVENTION

Figure 1:
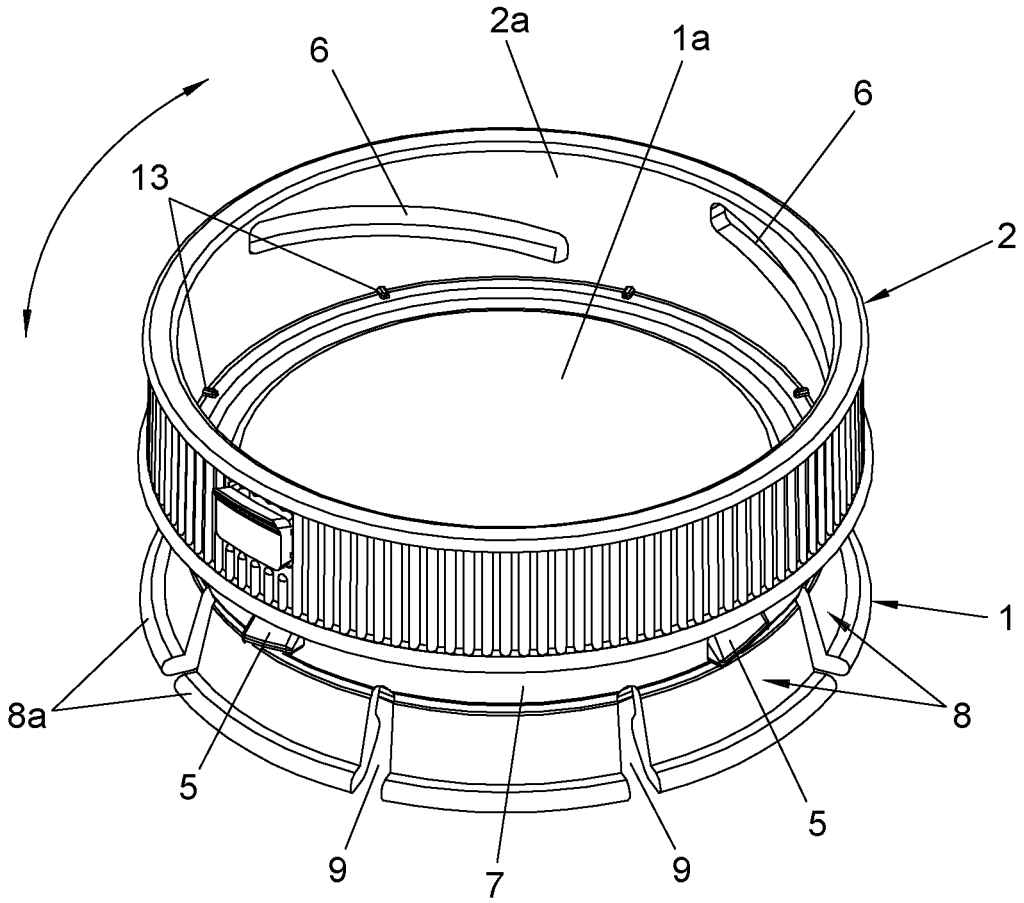
FIG. 1. —The invention relates to a perspective view of the cap, object of the invention.
Figure 2:
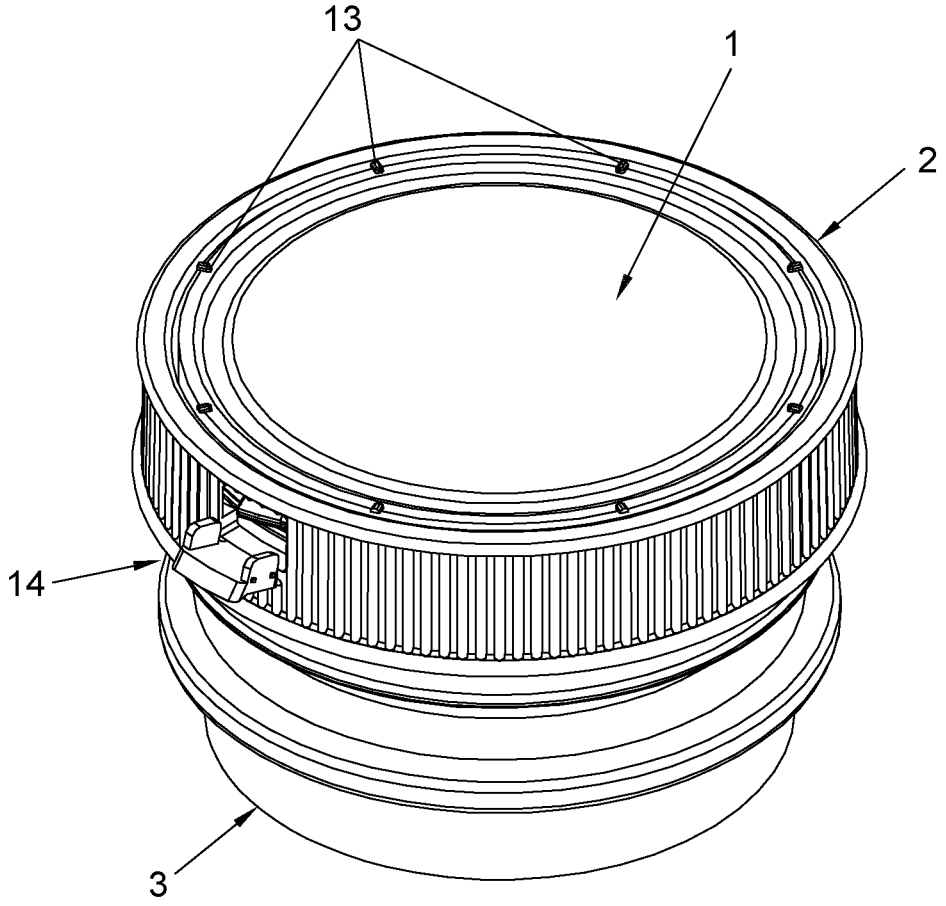
FIG. 2. —A perspective view similar to that shown in the previous figure, wherein an unlocked position of a sealing device is highlighted.

Considering the numbering adopted in the figures, the cap comprises a body 1 and an outer body 2, 2' coupled around the inner body 1; wherein the inner body 1 is adapted to engage around a neck 3 of a container 4 to close its mouth delimited by an annular rim 3*a* in which said neck 3 of the container 4 ends, such that said annular rim 3*a* comes into contact against an annular portion of an inner face of an upper base 1 to the inner body 1 of the plug.

The inner body 1 and the outer body 2, 2' have male elements 5 and female elements 6 that are complementary to each other; where the male elements 5 fit within the female elements 6; and wherein the rotation of the outer body 2, 2' causes it to move in an axial direction with respect to the inner body 1.

In a direction of rotation of the outer body 2, 2' the inner body 1 is locked to the neck 3 of the container 4 by sealing its mouth and in the other direction of rotation of the outer body 2, 2' the anchoring and locking of the inner body 1 is released, the assembly of the cap being removed and thus releasing the mouth of the container 4 in order to access its contents.

In the embodiment shown in the figures, the male elements 5 are integral to the inner body 1, while the female elements 6 are located on the outer body 2, 2', although in another embodiment the inner body 1 May include the female elements 6 and the outer body 2, 2' could include the male elements 5.

The inner body 1 includes a perimeter skirt 7 having a fragmentary bottom part in several legs 8 separated from one another by slots 9, so that above said legs 8 are located the male elements 5 integral to the inner body 1; wherein said lugs 8 include end edges covered by outwardly projecting end ribs 8*a*.

The succession of legs 8 have outer surfaces which form a frustoconical configuration with upwardly converging inclined generatrix 10, and internal surfaces including projections 11 which abut and press against an annular shoulder 12 of the neck 3 of the container 4 in a closing position of the closure of the invention when coupled to said neck 3 of the container 4.

The female elements 6 comprise internal helical path slots located on an annular inner surface 2*a* of the outer body 2, 2', while the male elements 5 comprise angular section lugs which are integral to an outer surface of the inner body 1; where said lugs also follow a helical path.

In another embodiment, the male elements 5 comprise cylindrical lugs, so that in this embodiment the lugs do not follow a helical path.

For coupling the outer body 2, 2' to the inner body 1 by engaging the male elements 5 within the female elements 6 by elastic snap, the outer body 2 is moved in an axial direction, 2' on the inner body 1, the outer body 2 being previously positioned, 2' around the inner body 1 above this 1, so that during this coupling operation, the elastic deformation of the two bodies 1, 2 of the plug it allows an upper part of the inner body 1 to fit inside a part of the outer body 2, 2' where the male elements 5 are located.

It is noted that in the embodiment shown in the figures, the cap is obtained by injection of plastic into a single piece (FIG. 1); where initially the outer body 2, 2' is attached to the inner body 1 by means of radial portions 13 thereof plastic material joining two adjacent annular edges of outer body 2, 2' and inner body 1.

When the outer body 2, 2' is mobilized in a first direction of rotation in which the latter the outer body 2 extends axially with respect to the inner body 1, said outer body 2, 2' is moved axially in a direction towards a tightening position where a lower edge 2*b* of the outer body 2, 2' contacts the outer surfaces of the lugs 8 which make up the perimeter skirt of the inner body 1 so as to rotate the outer body 2, 2' in that first direction of rotation, a circular recess delimited by the projections 11 is narrowing until said projections engage and press against the annular shoulder 12 of the neck 3 of the container 4.

In contrast, when the outer body 2, 2' is mobilized in a second direction of rotation, in which the outer body 2 moves axially with respect to the inner body 1, in this operation the tightening of the projections 11 against the annular shoulder 12 of the neck 3 of the container 4 is progressively released and thus the anchoring and locking of the cap is released; with which it is possible to separate it from the neck of the container 4 in order to thereby access the contents of the container 4.

On the other hand, the outer body 2, 2' includes a sealing device 14 that has a recess that is characterised in that it is intended for the purpose of the invention the fixing position blocks the rotation of the outer body 2, 2' with respect to the inner body 1, the cap is positioned in a position which seals the mouth of the container, and in another position of the sealing device 14 the lock is released from the rotation of the outer body 2, 2'.

The sealing device 14 comprises a hinged flange 15 located in correspondence with a through window 16 of the outer body 2, 2', so that said hinged flange 15 is attached to the outer body 2, 2' by means of a hinged hinge 17 which is also part of the outer body 2, 2'.

In the anchoring position of the hinged flange 15 when the mouth of the container 4 is sealed closed, said hinged flange 15 engages one of the male elements 5 of the inner body 1 by blocking the rotation of the outer body 2, 2', so that in this situation the hinged flange 15 closes the through window 16 occupying its space.

For this purpose, in the embodiment shown in the figures, the hinged flange 15 comprises two counter shaped flaps 18 which in the anchoring position of said hinged flange 15 are facing the end faces 5*a* of the male element 5, thus avoiding the rotation of the outer body 2 with respect to the inner body 1.

Figure 3:
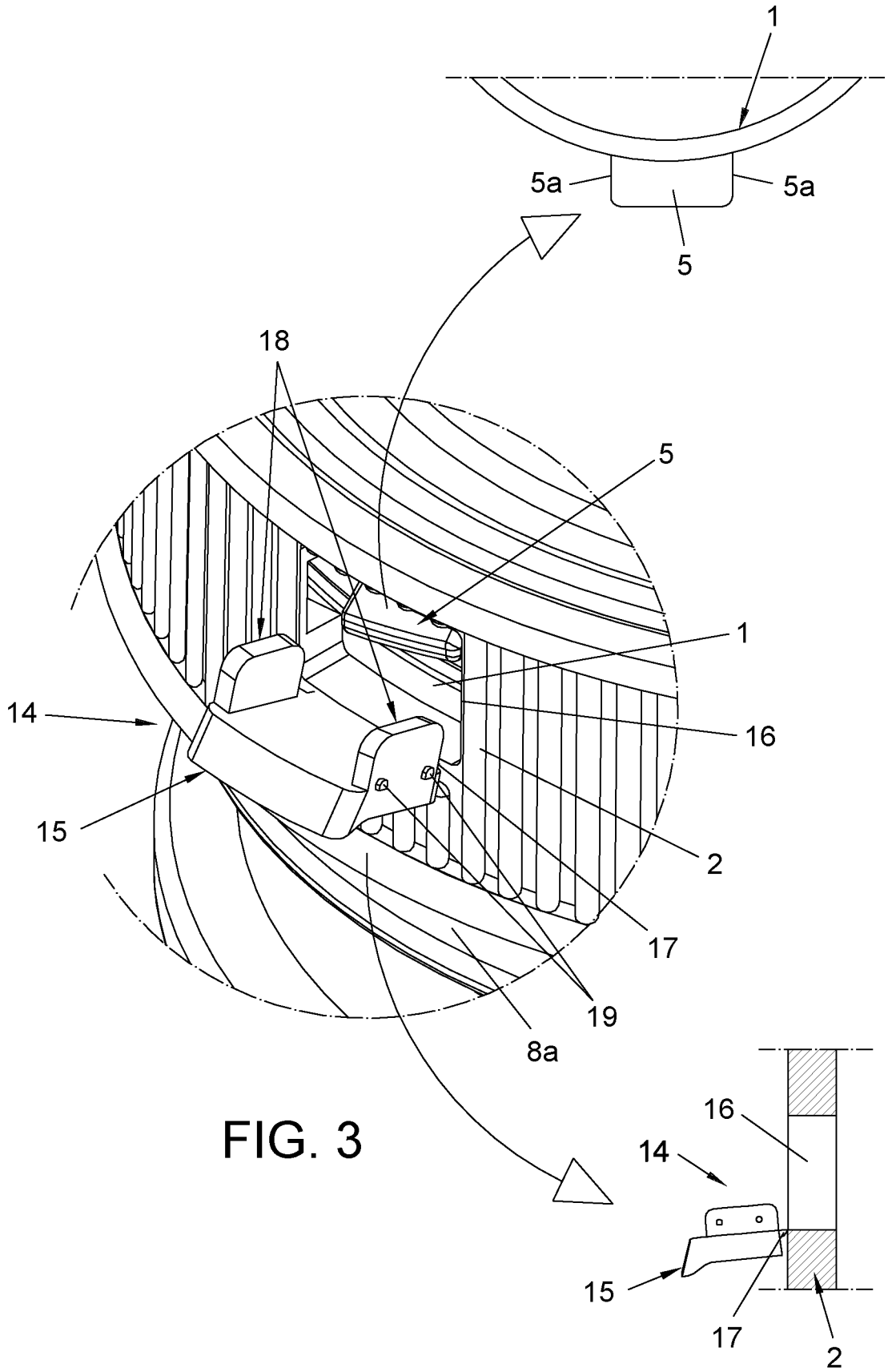
FIG. 3. —The invention relates to a detail view of the sealing device.
Figure 4:
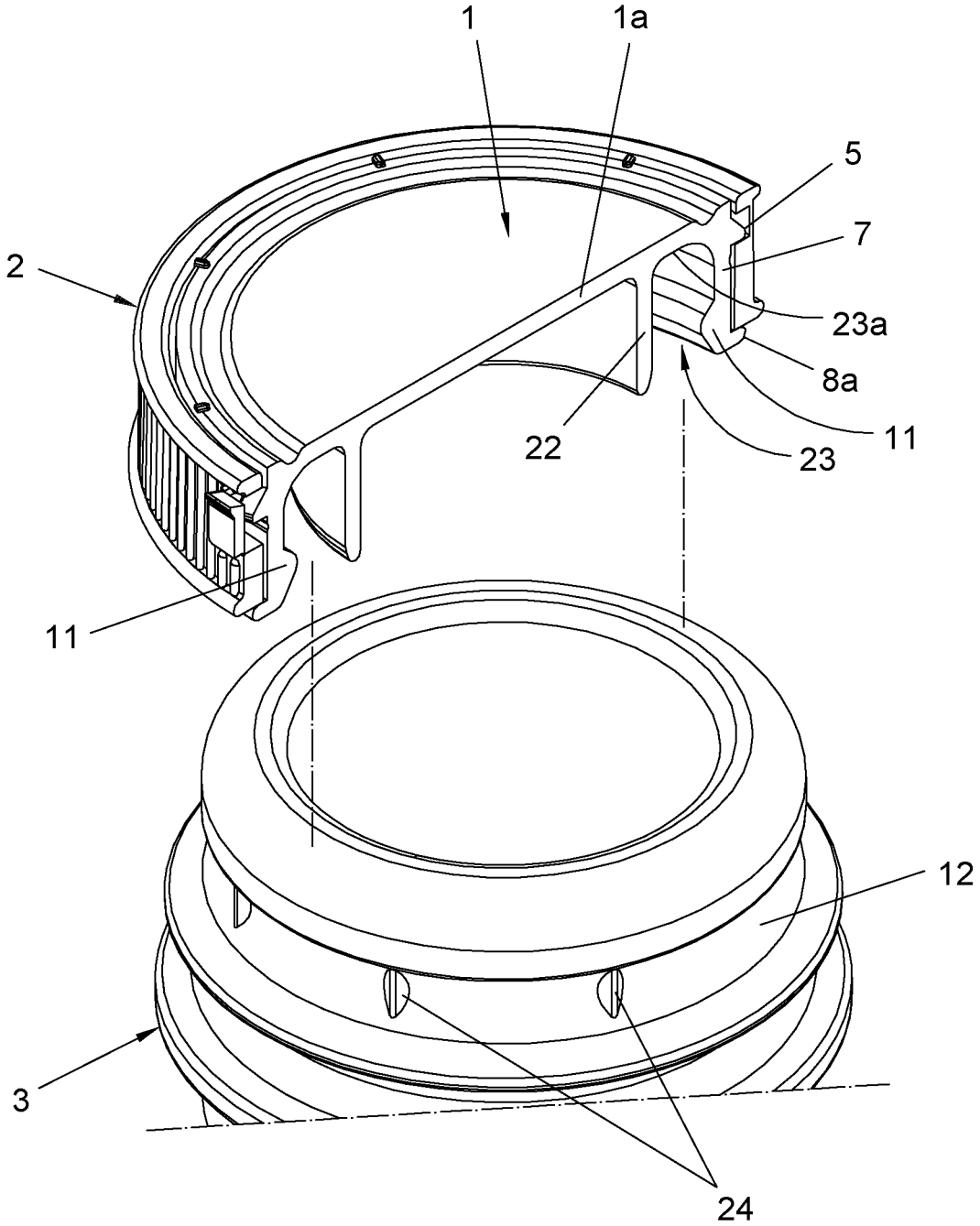
FIG. 4. —The invention relates to a section view of the mouthpiece of the invention the invention is coupled to the neck of the container.

In change in the position where the rotation of the outer body 2 is not blocked, the hinged flange 15 is not fitted into the through window 16 of the outer body 2, as shown more clearly in FIG. 3.

In the embodiment shown in the figures, the contracted wings 18 include lugs 19 which help to more securely maintain the anchoring position of the visor the invention is characterised in that it is intended for the purpose of the invention to be limited the invention relates to a hinged flange 15 in which said lugs 19 are in contact with two opposing faces of the through window 16 of the outer body 2, 2' so that said lugs 19 press against said back faces of the through window 16.

Figure 5:
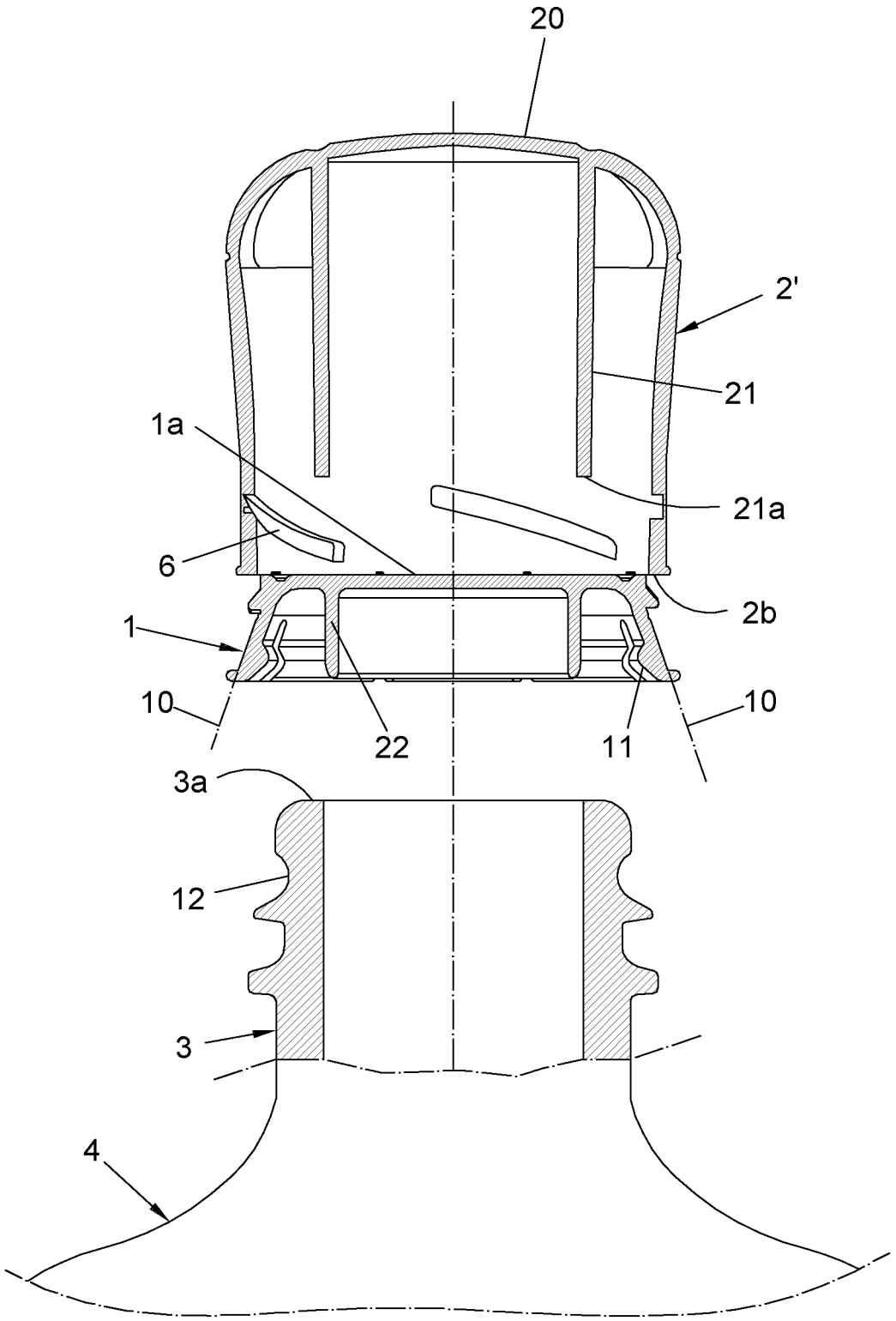
FIG. 5. —The invention relates to a section view of the cap of the invention the invention is characterised in that it according to a different embodiment than that shown in the previous figures.

In FIGS. 1 to 4, the outer body 2 comprises an annular ring shaped structure, while in FIG. 5 the outer body 2' comprises an annular structure closed by one of its ends by means of a base, in which an extension 21 is started of tubular configuration, although it may have another different configuration.

A lower edge 21*a* of the inner extension 21 is facing an outer face of the upper base 1*a* of the inner body 1, so that when the outer body 2' shown in FIG. 5 is rotated to close the mouth of the container 4, at the end of its rotation said lower edge 21*a* presses against the upper base 1 of the inner body 1 by providing a better closing of the mouth of the container 4.

On the other hand, the inner body 1 of the cap includes an inner annular partition 22 that tapers it is fitted against an internal surface of the neck 3 of the container 4, so that said inner annular partition 22 and the perimeter skirt 7 delimit an annular groove 23 having a bottom 23*a* where the annular edge 3*a* of the neck 3 of the container 4 seats.

Initially, when the cap is obtained by injection of plastic material, the hinged flange 15 is unique to the outer body 2, 2' through the hinged joint 17 and also through another point joint that will be allowed to break so as to be able to tilt outwards the hinged flange 15.

The annular shoulder 12 of the neck 3 of the container 4 includes radial projections 24 which interrupt the continuity of said annular shoulder 12, so that once the cap is coupled onto the neck 3 of the container 4, the radial ribs 24 fit into the slots 9 which separate the legs 8 from the inner body 1 of the plug; thereby ensuring the pivoting lock of the cap assembly with respect to the container.

The invention claimed is:

1. A cap configured to engage a neck of a container, the cap comprising:

an inner body and an outer body coupled around the inner body wherein a rotation of the outer body causes the outer body to move in an axial direction with respect to the inner body, wherein the inner body includes a perimeter skirt having a fragmentary bottom part in several legs, wherein the legs include outer surfaces which form a frustoconical configuration with an inclined generatrix converging upwards and inner surfaces with projections defining a circular recess, wherein the inner body and the outer body include male elements and female elements that are complementary to each other, wherein the male elements are fitted into the female elements, wherein either (i) the male elements are integral to the inner body, and the female elements are located on the outer body, or (ii) the inner body includes the female elements and the outer body includes the male elements, wherein the female elements comprise internal grooves of helical travel, and the male elements comprise protruding lugs, and wherein the outer body comprises an annular structure closed at one end by means of a base, where an internal extension has a lower edge facing an upper base of the inner body.

2. The cap according to claim 1, wherein the male elements are cylindrical lugs, or the male elements are angular section lugs that follow a helical path.

3. The cap according to claim 1, wherein the female elements comprise internal grooves of helical travel located in an annular inner surface of the outer body, while the male elements comprise lugs protruding from an outer surface of the inner body.

4. The cap according to claim 3, wherein the male elements are angular section lugs which follow a helical path, or in that the male elements are cylindrical lugs.

5. The cap according to claim 1, wherein the legs include end edges capped by outwardly projecting terminal projections.

6. The cap according to claim 1, wherein the outer body comprises an annular ring shaped structure.

7. The cap according to claim 1, wherein the internal extension has a tubular configuration.

8. The cap according to claim 1, wherein the inner body of the cap includes an inner annular partition disposed concentrically with respect to the perimeter skirt, and wherein between the inner annular partition and the perimeter skirt an annular groove having a bottom is formed.

9. The cap according to claim 1, wherein the cap is made of polyethylene by injection molding of plastic material.

10. A bottle type container comprising:

a neck, wherein the neck has on its exterior a perimeter shoulder; and a cap according to claim 1, wherein the inner body of the cap is adapted to engage around the neck of the container to close its mouth delimited by an annular rim in which the neck of the container ends, such that the annular rim comes into contact with an annular portion of an inner face of an upper base to the inner body of the cap.

11. A cap configured to engage a neck of a container, the cap comprising:

an inner body and an outer body coupled around the inner body, wherein the rotation of the outer body causes the outer body to move in an axial direction with respect to the inner body, wherein the inner body includes a perimeter skirt having a fragmentary bottom part in several legs, and wherein the several legs include outer surfaces which form a frustoconical configuration with an inclined generatrix converging upwards; and inner surfaces with projections defining a circular recess, and a sealing device to block the rotation of the outer body with respect to the inner body, wherein the sealing device further comprises a hinged flange located in correspondence with a through window of the outer body and wherein the hinged flange is joined to the outer body at least by a hinged hinge.

12. The cap according to claim 11, wherein the hinged flange comprises two opposing fins which in an anchoring position of the hinged flange, are facing end faces of the male element, thus avoiding the rotation of the outer body with respect to the inner body.

13. The cap according to claim 12, wherein the opposing fins of the hinged flange include lugs which fit against two opposing faces of the through window.

14. The cap according to claim 11, wherein the outer body comprises an annular ring shaped structure.

15. The cap according to claim 11, wherein the outer body comprises an annular structure closed by one of its ends by means of a base, where an internal extension has a lower edge facing an upper base of the inner body.

16. The cap according to claim 15, wherein the internal extension has a tubular configuration.

17. The cap according to claim 11, wherein the inner body of the cap includes an inner annular partition disposed concentrically with respect to the perimeter skirt; wherein between the inner annular partition and the perimeter skirt an annular groove having a bottom is formed.

18. The cap according to claim 11, wherein the cap is made of polyethylene by injection molding of plastic material.

* * * * *